US005784846A

United States Patent [19]

Godschalx

[11] Patent Number: 5,784,846

[45] Date of Patent: *Jul. 28, 1998

[54] STRUCTURE AND METHOD OF REDUCING AND REDISTRIBUTING UPLIFT FORCES ON MEMBRANE ROOFS

[75] Inventor: Raymond D. Godschalx, Rancho Cucamonga, Calif.

[73] Assignee: Building Materials Corporation of America, Wayne, N.J.

[ * ] Notice: The term of this patent shall not extend beyond the expiration date of Pat. No. 5,579,619.

[21] Appl. No.: 900,053

[22] Filed: Jul. 24, 1997

Related U.S. Application Data

[63] Continuation of Ser. No. 479,312, Jun. 7, 1995, which is a continuation-in-part of Ser. No. 316,595, Sep. 30, 1994, Pat. No. 5,579,619.

[51] Int. Cl.[6] ..... E04B 5/12

[52] U.S. Cl. ..... 52/409; 52/410; 52/746.11; 52/741.4

[58] Field of Search ..... 52/408–413, 741.4, 52/746.1, DIG. 7

[56] References Cited

U.S. PATENT DOCUMENTS

| | | | |
|---|---|---|---|
| 3,817,009 | 6/1974 | Elder | 52/173 |
| 4,223,486 | 9/1980 | Kelly | 52/1 |
| 4,409,761 | 10/1983 | Bechtel | 52/1 |
| 4,557,081 | 12/1985 | Kelly | 52/94 |
| 4,583,337 | 4/1986 | Kramer et al. | 52/302 |
| 4,608,792 | 9/1986 | Gerber | 52/199 |
| 4,677,800 | 7/1987 | Roodvoets | 52/309.12 |
| 4,712,349 | 12/1987 | Riley et al. | 52/408 |
| 4,888,930 | 12/1989 | Kelly | 52/410 |
| 4,926,596 | 5/1990 | Yeamans | 52/408 |
| 5,167,579 | 12/1992 | Rotter | 454/365 |
| 5,392,576 | 2/1995 | Yeamans | 52/408 |
| 5,579,619 | 12/1996 | Godschalx | 52/409 |

OTHER PUBLICATIONS

Thomas E. Phalen, Jr. *Design and Analysis of Single–Ply Roof Systems,* Chapter 6, pp. 248–287 (1993).

H.J. Gerhardt and C. Kramer, "Wind Safety of Single–Ply Roofs Under Time Varying Wind Load," *Journal of Wind Engineering and Industrial Aerodynamics,* 41–44 (1992) 1513–1524.

Jorge Pardo, "Wind Performance Limits of Roof Ballast Pavers," *Journal of Wind Engineering and Industrial Aerodynamics,* 36 (1990) 689–698.

Advertisement of Greenstreak for Yellow Spaghetti dated Nov. 1992 (2 pages).

Flyer of Greenstreak for Yellow Spaghetti, date ? (2 pages).

*Primary Examiner*—Carl D. Friedman
*Assistant Examiner*—W. Glenn Edwards
*Attorney, Agent, or Firm*—Seidel Gonda Lavorgna & Monaco, PC

[57] ABSTRACT

A roof structure and method for reducing uplift on a roof resulting from a wind blowing over the roof at a rooftop wind speed. The roof has a membrane overlying a deck. An air permeable and resilient mat is installed over the membrane. The mat has openings of a size to reduce the wind velocity passing through it to the membrane while the openings being of a size that the mat is not lifted by a pressure differential therein reducing uplift on the membrane.

5 Claims, 13 Drawing Sheets

STRUCTURE AND METHOD OF REDUCING AND REDISTRIBUTING UPLIFT FORCES ON MEMBRANE ROOFS

This is a continuation of application Ser. No. 08/479,312 filed Jun. 7, 1995. Forces which is a continuation-in-part of Ser. No. 08/316,595, filed Sep. 30, 1994, now U.S. Pat. No. 5,579,619.

FIELD OF THE INVENTION

This invention is related to the general field of membrane roofs, commonly referred to as flat or low-sloped roofs, and more particularly is related to a structure and method of distributing and reducing the uplift forces across the roof which are caused by wind velocity.

BACKGROUND OF THE INVENTION

A common roof style for commercial and industrial buildings, apartment complexes and row homes is the flat or low-sloped roof. Although nominally flat, this roof style usually has a slight slope or pitch to cause and direct drainage. For purposes of brevity, the term "flat roof" will be used hereafter to describe roofs of this style.

A flat roof comprises at a minimum a deck and a waterproof membrane. An insulation layer can be, and frequently is, installed between the deck and the membrane.

There are two basic categories of flat roof construction. In the built-up roof system (BUR), felt and bitumen are layered to form the waterproof membrane, and a layer of gravel or a coating is placed on top to protect the membrane from ultraviolet radiation. In the single-ply roofing system (SPM), a single elastomeric sheet overlies the deck.

The primary purpose of any roof is to separate the exterior atmosphere from the interior of the building, and maintain the integrity of that separation during all weather including expected extremes of ambient weather conditions throughout a reasonable lifetime. This requirement involves several design factors, which include the consideration of: (1) external and internal temperatures; (2) external moisture, air moisture, rain, snow, sleet and hail; (3) wind uplift of the membrane; (4) impact resistance to weather and other effects such as dropped tools and walking; (5) the esthetics of the roof; and (6) influence of solar radiation and ultraviolet rays.

For flat roofs, the ability to withstand uplift forces caused by wind across the roof surface is one of the more critical design factors. The roof is a major portion of the surface area in building structures, accounting for as much as 40% of the surface area. Wind across the roof produces uplift forces at the roof surface, which may cause detachment and billowing of the membrane, scattering of ballast, and even catastrophic roof failure in extreme situations. Consequently, the flat roof design normally incorporates one or more features to counter the wind uplift forces, as described below.

In a single-ply roof, one of the most common methods of countering uplift forces is the use of stone ballast. The waterproofing membrane is completely covered with a uniform layer of stone aggregate (usually #4 river rock or equivalent, ¾" to 2½' diameter), at layer depth sufficient to produce a down-load pressure of approximately 10 pounds per square foot. The substantial weight of this aggregate is an added load to the roof and support structure which must be factored into the design of the building.

However, a major problem with stone ballast is that strong winds often cause the ballast stones to shift position, clustering in some areas and uncovering the membrane in other areas. This phenomena is referred to as scouring. Where the migration of the aggregate results in areas that are clear of ballast, the exposed membrane can billow upward from the aerodynamic lift of the wind, resulting in the membrane becoming damaged or disengaged. The membrane uplift and billowing accelerates the migration of ballast. Therefore, the exposed membrane has increased exposure to UV rays.

Another counter to uplift forces in single-ply roofing systems involves mechanically affixing the waterproofing membrane and any underlying insulation to the deck with fasteners, which anchor the membrane and transfer the uplift load to the deck. The fasteners experience lateral and vertical loads, including uplift on the membrane, the oscillating loads of membrane billowing, and deck flutter, which may over time cause the fasteners to become disengaged, ultimately backing out and leaving the membrane unsecured. A backed-out fastener may puncture the waterproofing membrane, and membrane billowing can increase the forces acting on the membrane seams, therein resulting in seam failure.

Another alternative is to fully adhere the waterproofing membrane to the top surface of a subcomponent sheet, which has in turn been mechanically affixed to the roof deck. The adhesive bond between waterproofing membrane and subcomponent's top surface is subjected to uplift forces from the passage of wind over the membrane. Both the subcomponent material and the adhesives are usually sensitive to moisture and condensation, which over time cause adhesive bond failure. Subsequent membrane failure occurs as oscillating and billowing causes the membrane to peel from the substrate.

The built-up roof must also counter the effect of uplift forces, in that the built-up layers of felt and bitumen can delaminate, and chunks of asphalt/felt can be blown off the roof. The built-up roof system also experiences scouring problems when loose gravel is used as the top layer to protect the membrane from ultraviolet radiation. In fact, the smaller sized gravel migrates even more easily than the larger ballast stone used with single-ply roofs.

Consequently, their has been a continuing need for better methods and structures to counter the effects of uplift forces, or to counter the uplift forces directly.

One method of countering uplift, in the type of roof where insulation panels are installed on top of the membrane, is disclosed in U.S. Pat. No. 4,583,337, which teaches installing corrugated cover members overlying insulation panels along the periphery of the roof. The wind flowing around the corrugated cover members is purported to create a vacuum under the cover members, so that the differential pressure pulls the cover members downward against the insulation to counter the uplift on the insulation, and thus retain the insulation.

U.S. Pat. No. 4,926,596 discloses an apertured overlay that is stretched over the membrane. The apertured overlay is secured at the periphery of the roof, and allows wind to pass through to the membrane. The overlay physically restrains the waterproof membrane from billowing.

Both of these methods counter the uplift by creating an opposing force on the membrane, and in that sense are related in concept and approach to the older methods of ballast, mechanical fasteners, and adhesives. It is an object of the present invention to counter the uplift in different manner, in which the uplift force itself is reduced, and the uplift force is more uniform across the roof surface.

In addition to its efficacy in reducing and evenly distributing uplift forces, another major advantage of the present invention is that it can be used alone or in conjunction with other uplift countering methods, such as ballast, affixed or adhered membrane, and built-up roofs, and in fact makes these other methods even more effective than they would be if used alone. For example, the elimination of scouring permits the use of a smaller-size aggregate for ballast, and the reduction of uplift force permits the use of less total weight of ballast. The reduction and more even distribution of uplift forces reduces the frequency and likelihood of fastener or adhesive bond failure, or delamination of built-up roofs. Further, the invention itself provides a resilient cover to the roof therein protecting from physical damage and reduces the ultraviolet rays reaching the membrane.

Further objects, features and advantages of the present invention will become more apparent to those skilled in the art upon reading and comprehending the embodiment described below and illustrated in the accompanying drawings.

SUMMARY OF THE INVENTION

This invention relates to a roof structure for and method of reducing and distributing uplift forces resulting from wind blowing across a flat roof. The roof structure includes a waterproof membrane overlying a deck, and is characterized by an air permeable and resilient mat which is installed over the membrane. The mat has a random convoluted mesh of a size which breaks up the laminar flow of wind passing over the membrane, slows and defuses the wind velocity directly above the membrane, and permits pressure equalization within the mat.

The preferred mat is constructed of synthetic fibers randomly aligned into a web and bonded together at their intersections, forming a relatively rigid mat having significant porous area between the random fibers to disrupt and diffuse the wind over the membrane.

BRIEF DESCRIPTION OF THE DRAWINGS

For the purpose of illustrating the invention, the drawings show a form which is presently preferred. However, this invention is not intended to be limited, nor is it limited, to the precise arrangement and instrumentalities shown. The scope of the invention is determined by the claims found at the end of this description.

When referring to the drawings in the description which follows, like numerals indicate like elements, and primes ("and") indicate counterparts of such elements.

DETAILED DESCRIPTION OF THE INVENTION

Figure 1:
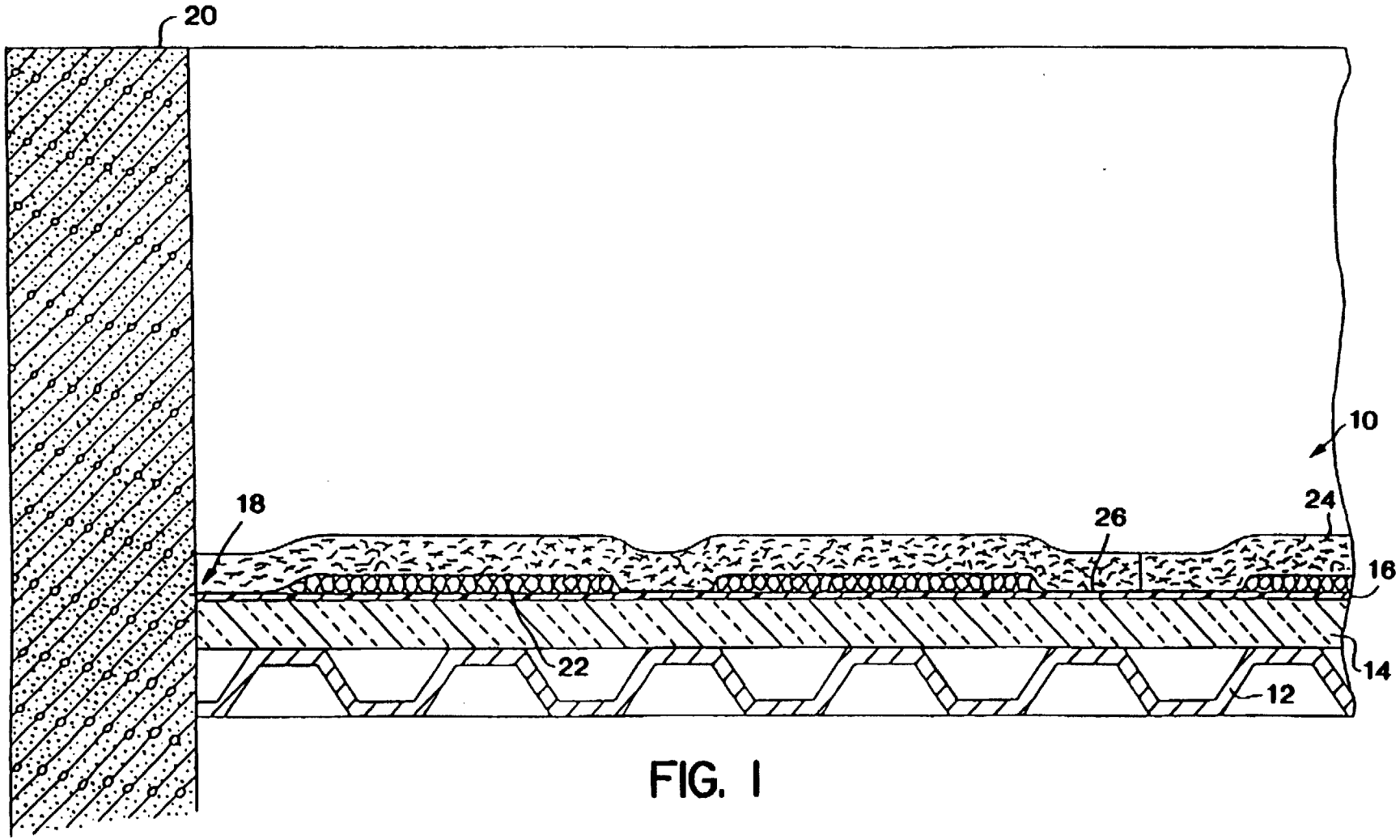
FIG. 1 is a cross-sectional view of a single-ply stone-ballasted roof according to the invention.

FIG. 1 illustrates an embodiment of a roof structure 10 according to the invention. The structure includes a roof decking 12 and an insulation layer 14 laid on and overlying the decking. In a preferred embodiment, the roof has a single-ply waterproof membrane 16 secured at the periphery 18 of the roof deck in proximity to the roof parapet 20 by conventional methods. The single-ply membrane is not secured except at the roof periphery and simply overlies the insulation. The single-ply membrane 16 is formed in sheets which are bonded together by heat welding, solvent welding or adhesives, to form a larger sheet as required to cover the entire roof.

Overlying the single-ply membrane 16 is a layer of gravel aggregate 22 used as ballast. The size of the aggregate 22 is ⅜ of an inch nominal diameter gravel. This is considerably finer than the stone aggregate of prior ballasted single-ply roofs which require #4 river rock (2" to 2½" diameter). The rate application per square is less than a typical rate of 10 pounds per square for conventional construction. (A square is 100 square feet, a common term in roofing.)

An air permeable and resilient mat 24 overlies the aggregate 22. The mat preferred is a nonwoven air permeable and resilient mat made of synthetic fibers (usually nylon, PVC or polyester) which are opened and blended, then randomly aligned into a web by air flow. The web is treated with binding agents of water based phenolics and latexes. The treated web is then oven cured to bind the fabrics into relatively rigid mat having significant porous area between the random fibers. (The machinery used to produce this material is sometimes called a "Rando-Webber").

U.S. Pat. No. 5,167,579 describes an air permeable and resilient mat being used in conjunction with a ridge vent of a sloped roof. The further description of the mat material found therein is incorporated by reference, should any further description be sought. In a preferred embodiment, the mat material has a thickness of ⅛ of an inch and comes in rolls 78 inches wide and 60 yards long. The material weighs 11.11 pounds per square (1.8 oz./ft$^2$) and has a percent open area of 65%.

Figure 2:
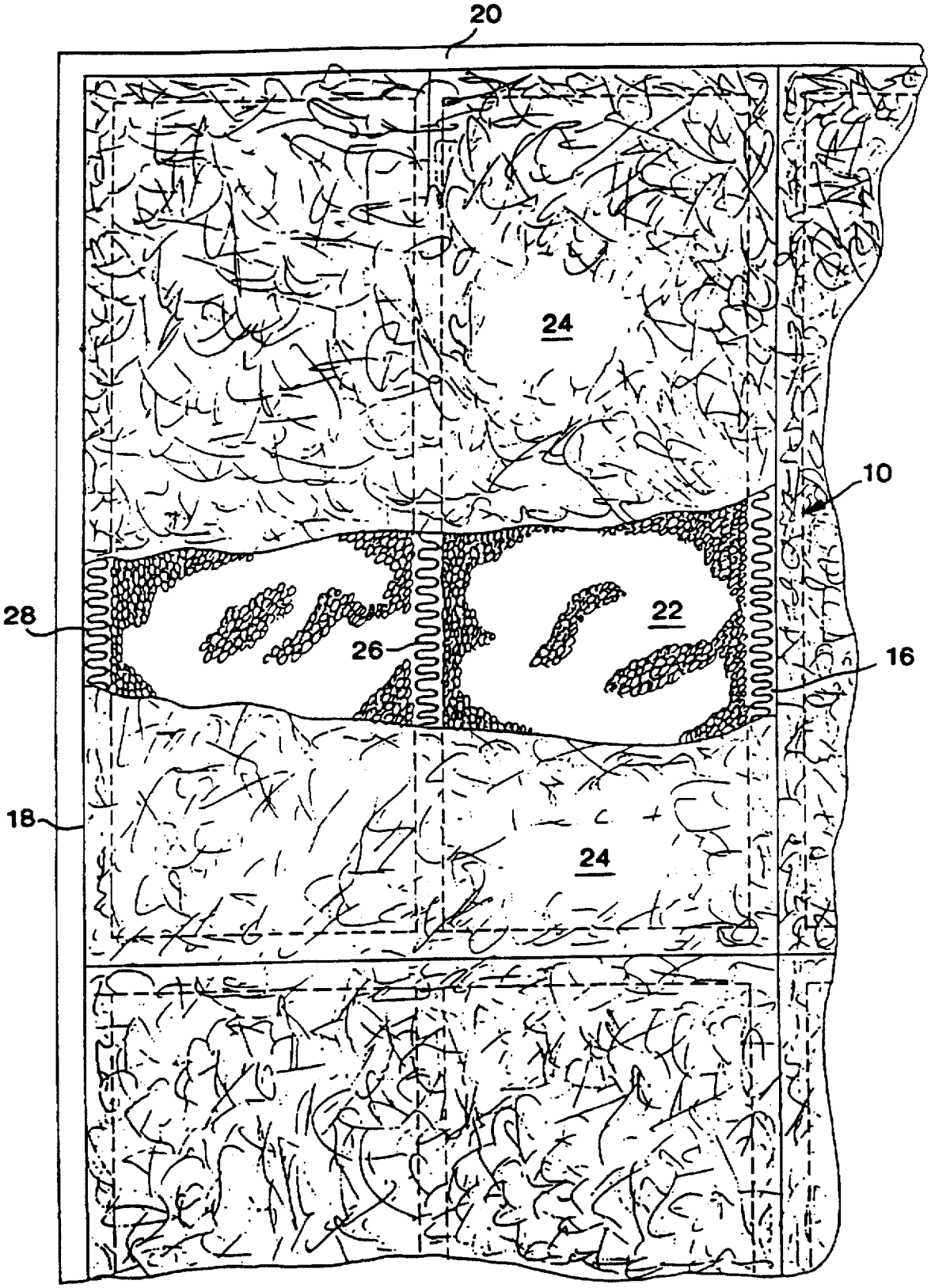
FIG. 2 is a top view of the roof of FIG. 1 with portions of the mat broken away.

The aggregate can be laid in an even coverage layer over the roof, and then after shoveling out a row or grid pattern and sweeping the open grid lines clean, the air permeable and resilient mat 24 is laid over the aggregate and secured to the membrane at the bare grid lines by adhesive, as shown in FIG. 2, where a 3-inch strip adhesive region 28 is shown. An adhesive 26 such as COBRA® Venom sold by GAF Building Materials Corp, or a neoprene cement, or a tape may be used to secure the mat 24 to the membrane 16. Small gaps are positioned in the adhesive to allow water to drain properly.

The mat 24 retains the aggregate ballast 22 in the grid pattern, thus preventing the phenomena of scouring, which would otherwise occur with such small aggregate. In addition, as discussed below, the mat reduces the wind speed across the ballast 22.

Theory behind wind uplifts

In the designing of a roof, the pressure differential on the membrane has to be determined. However, in the design of the roofs, not only average day basic wind speed has to be considered, but winds associated with hurricanes and thunderstorms and Foehnlike winds need also to be considered. Therefore, tables, charts and equations are required to determine the maximum uplift force on the membrane. One of the items that has to be determined is the basic wind speed ($V_o$). The speed of the wind is constantly changing. Therefore, the basic wind speed ($V_o$) is the average wind speed over time.

The speed of the wind at the roof top ($V_R$) is calculated as a function of the basic wind speed ($V_o$), the height above the ground the roof is located (basic wind speed ($V_o$) is typically measured at 32.8 feet (10 m)), and the type of terrain in the area. There are numerous theories on how to determine roof top wind speed ($V_R$) including methods from the Uniform Building Code, ANSI Standards, and Factory Mutual Standards, Standard Building Code. These theories each achieve different results but the underlying equation is the same and is $V_R=AV_O^mH^n$. The constant "A" and exponent "n" are functions of ground roughness. The exponent "m" is a power constant and typically about 1.0. H represents the building height.

Typically, the wind speed on the roof surface ($V_S$) is greater than the roof top wind speed ($V_R$). The roof top wind speed is determined by the local wind speed as described above. Roof top wind speed ($V_R$) is the speed of the wind at that height of the roof and does not include the change of wind speed because of the interaction with the roof.

Using Bernoulli's equation $$P_R/\gamma+V^2_R/2\ g=P_S/\gamma+V^2_S/2\ g$$

where $P_R$ is the air pressure roof top level and $P_S$ is the air pressure on the roof's surface, the equation is rearranged to achieve a dimensionless coefficient of pressure $$C_P=\Delta p\ (2\ g)/\gamma V^{2R}.$$

Therefore, substituting $C_p$ into the equation results in $V_S=V_R(1-C_p)^{0.5}$. It is this pressure differential that exerts a force on the membrane causing the membrane to lift. Since the volume of wind having to pass over the roof includes a portion of the wind that would have typically passed through the space occupied by the building, the velocity over the roof ($V_S$) must be greater than the roof top wind speed ($V_R$). Therefore, $C_p$ must be negative.

Figure 3:
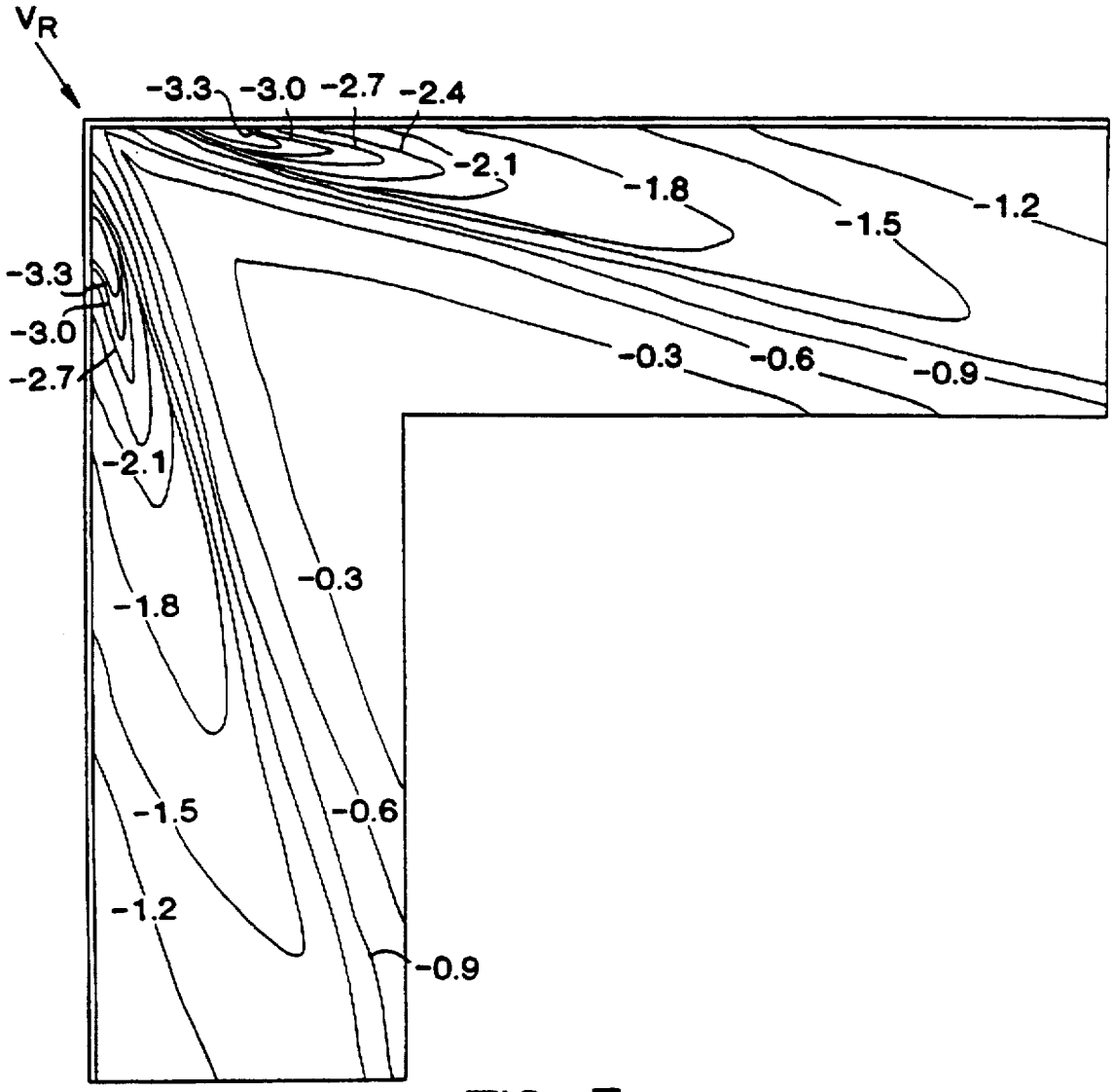
FIG. 3 is a graphical presentation of the external pressure distribution above a corner of a flat roof which does not incorporate the invention.

It has been recognized that the maximum coefficient of $C_p$ occurs when the wind impinges at 45° relative to the roof as shown in FIG. 3. The maximum coefficient of pressure is about −3 to −3.3 for a roof without parapets.

Parapets lower the maximum coefficient of pressure (e.g., maximum −2.5). However, while the coefficient of pressure is lowered, the area influenced by the new maximum pressure is increased. The force on the membrane could be actually higher for a roof with parapets. Factors included in determining the force are the height of the parapets and the surface area of the roof.

Critical pressure points on a membrane roof

Typical pressures in four areas have to be determined before determining the pressure differential acting on the membrane 16. The pressures that need to be identified are the external pressure ($P_R$) associated with roof top wind speed ($V_R$), the pressure in the interior of the building structure 10 ($P_I$) underlying the membrane 16, the roof surface pressure ($P_S$) associated with the roof surface wind speed ($V_S$) and the pressure on top of the membrane ($P_M$) The pressure on top of the membrane ($P_M$) would equal the roof top surface pressure ($P_S$) if the membrane did not have an intervening layer such as ballast 22 or the air permeable and resilient mat 24.

The pressure on the interior of the structure 10 ($P_I$) would be equal to the roof top level pressure ($P_R$) if the structure was completely open. If this was the case, the differential pressure would be equal to zero. However, structures 10 are not completely open and more closely resemble an unvented case. In this situation, the internal pressures ($P_I$) equals the roof top flowable air pressure ($P_R$) when there is no wind or before the wind begins to blow. The internal pressure can, in addition, be influenced by the air handling and conditioning system in the building. Air handling system usually places a positive pressure in the structure resulting in a greater pressure differential. If the roof decking 12 were sealed such that no air could penetrate, a vacuum could be created under the membrane 16. This vacuum would contract the uplift. However, due to normal cracks and openings in the deck, the pressure below the membrane 16 is assumed to be equal to the pressure inside the building ($P_I$).

In comparing the pressure at the roof surface ($P_S$) to that at the top of the membrane ($P_M$), Bernoulli's equation can be used. As indicated previously, the wind speed of the roof surface ($V_S$) is larger than the wind speed at the membrane. Therefore, the relationship may be written as $$V_S=kV_M$$

where K is a constant that is less than 1. Therefore, the pressure of the membrane equals the $$P_M=P_S+V^2_R(1-C_p)(1-K^2)\gamma/2\ g$$

In field test, the constant for the air permeable and resilient mat 24 has been determined to be approximately 0.1. The air permeable and resilient mat reduces the wind velocity passing over the membrane 16 to one-tenth the speed of roof top wind speed ($V_S$).

Theory on Why Air Permeable and Resilient Mat Succeed

While not wishing to be bound by theory, it is thought that the air permeable and resilient mat is successful in reducing uplift of the membrane because: 1) the mat reduces the wind velocity over the membrane, 2) the mat is porous so that any lateral forces generated by the wind are compensated by the static coefficient of friction of the mat with the roof, 3) the surface of the mat creates turbulence over the roof therein disrupting uplift and 4) if there is ballast, the mat limits scouring of the ballast.

Reduce wind velocity over the membrane

In order for the wind to pass over the membrane, the wind must pass through the mat. The mat is comprised of synthetic fibers randomly aligned into a web having significant porous area to allow the wind to pass through the mat. However, the wind as it flows past the fibers are subject to boundary-layer effects resulting in the flow engaging the fibers being zero. The fibers are sufficiently close (35% of the mat is fiber) that while the wind flows through the mat, the speed of the wind passing through the mat is greatly reduced.

By reducing the wind uplift forces acting on the roof surface, the mat reduces the load required for the uplift forces on the building structural components, reducing construction costs.

No uplift on mat

As indicated above, the uplift of the membrane is created by the change of pressure (Δp) across the membrane resulting because the velocity under the membrane is substantially zero. The mat having significant porous area between the fibers has essentially the same pressure above and below the mat. Wind gusts are not constant, and therefore, the mat can dissipate the pressure differential over time, when the velocity of the wind approaches zero.

Turbulence

The mat having a porous surface and wind blowing through and across the mat create turbulence. The laminar flow of the wind is converted to turbulent flow. Whereas the laminar flow has a primary vectorial direction which transfers the energy of the wind into reducing the pressure and creating uplift, the turbulent flow has wind vectors in $4\pi$ steradians. The resulting average of all the vectors is a net velocity in any given direction that is less than that found in the laminar flow.

Limit scouring

In conventional ballasted single-ply roofs, the roof surface wind speed ($V_s$) engages the ballast on primarily one surface. The wind exerts a force on the ballast pushing it in a windward direction. The mat overlying the ballast reduces the wind speed on the ballast which is equal to the roof surface wind speed ($V_s$). In addition, the mat exerts a downward force on the ballast therein creating a larger force (weight) that the wind must move. Moreover, the contact of the mat with the ballast increases the static coefficient of surface friction and increases the critical velocity. In addition, the mat adhered to the membrane defines grids which contain the ballast. Therefore, the size of the ballast can be reduced without concern of scouring of the ballast.

Wind Tunnel Test

Figure 4:
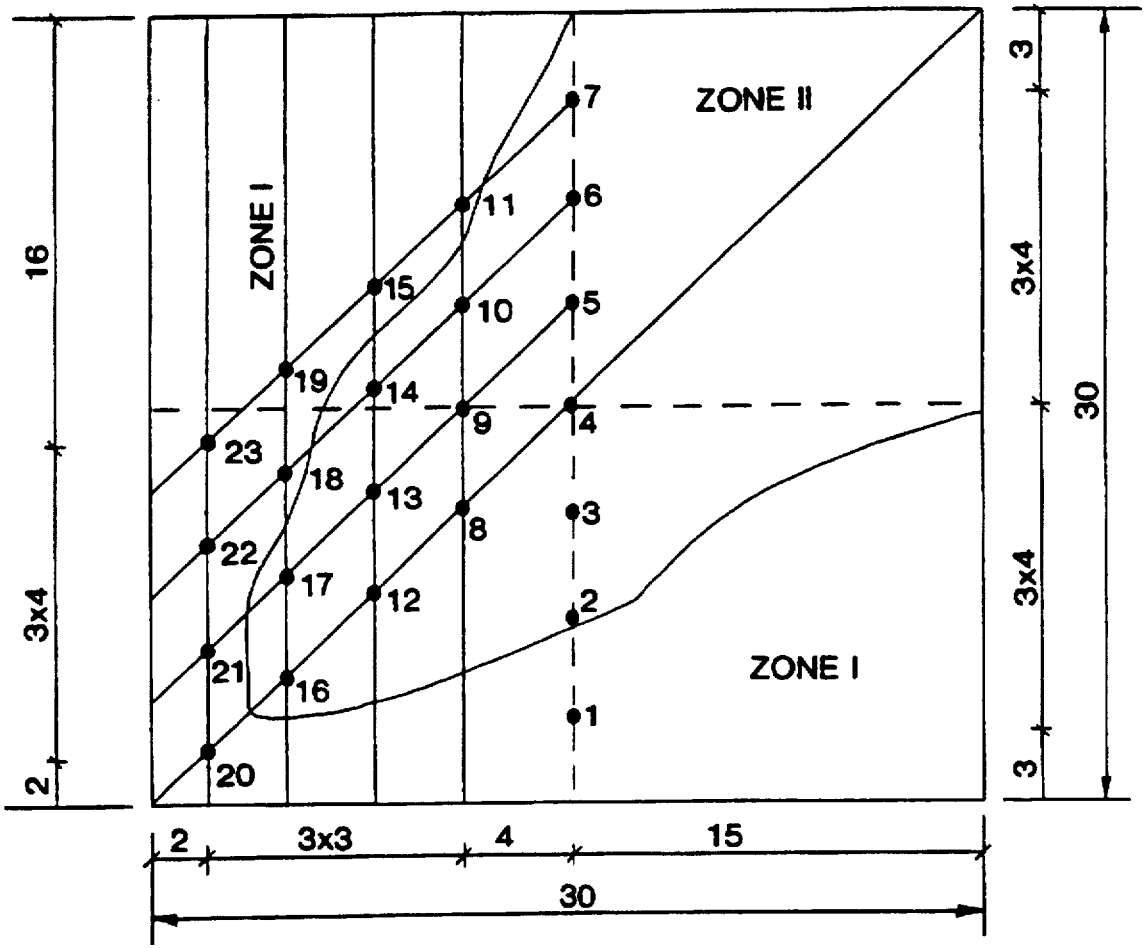
FIG. 4 is a schematic representation of small-scale roof model for wind tunnel testing, with the locations of pressure sensors identified.

A wind tunnel test was conducted to measure the coefficient of pressure ($C_p$) on the membrane, and is related to the pressure on top of the membrane ($P_m$). The model of the building had a roof area of 30 cm.×30 cm. Twenty three pressure taps were located on the model roof to determine the pressure at various locations across the membrane. FIG. 4 is a schematic representation of the small scale roof model that was wind tunnel tested with the pressure taps, pressure sensors, identified.

Tests were conducted with the wind flow both normal to one of the walls of the roof and diagonal such that the wind impinged at 45° relative to the roof as shown in FIG. 4. In addition, the roof was tested with the initially flow both being a smooth flow and a turbulent flow wind. While the tests were done in non-boundary layer wind and therefore absolute values of the pressure coefficients could not be extrapolated to fall scale, the wind tunnel test clearly showed the benefit of the air permeable and resilient mat 34.

The data for the worse cause situation for both uplift and scouring (i.e. smooth flow impinging at a diagonal) is listed in following table. In analyzing the data, two zones of effect were found. The approximate demarcation of the two zones is shown in FIG. 4.

| | Cp(mean) | | Cp(min) | | Cp(rms) | |
|---|---|---|---|---|---|---|
| Tap No. | with mat | w/o mat | with mat | w/o mat | with mat | w/o mat |
| | ZONE I | | | | | |
| 11 | −1.03 | −1.06 | −1.12 | −1.23 | 0.026 | 0.099 |

-continued

| | Cp(mean) | | Cp(min) | | Cp(rms) | |
|---|---|---|---|---|---|---|
| Tap No. | with mat | w/o mat | with mat | w/o mat | with mat | w/o mat |
| 15 | −1.05 | −1.47 | −1.13 | −1.60 | 0.025 | 0.070 |
| 18 | −1.09 | −2.11 | −1.17 | −2.23 | 0.025 | 0.086 |
| 19 | −1.07 | −2.04 | −1.18 | −2.53 | 0.025 | 0.127 |
| 20 | −1.12 | −3.13 | −1.20 | −3.82 | 0.023 | 0.348 |
| 21 | −1.11 | −3.93 | −1.19 | −4.20 | 0.028 | 0.110 |
| 22 | −1.14 | −2.94 | −1.25 | −3.43 | 0.028 | 0.185 |
| 23 | −1.10 | −2.19 | −1.18 | −2.66 | 0.026 | 0.179 |
| | ZONE II | | | | | |
| 5 | −1.02 | −0.67 | −1.11 | −0.72 | 0.023 | 0.015 |
| 6 | −1.02 | −0.63 | −1.13 | −0.69 | 0.026 | 0.019 |
| 7 | −1.01 | −0.78 | −1.12 | −0.91 | 0.027 | 0.045 |
| 8 | −1.09 | −0.75 | −1.18 | −0.80 | 0.020 | 0.011 |
| 9 | −1.07 | −0.69 | −1.16 | −0.73 | 0.027 | 0.014 |
| 10 | −1.05 | −0.68 | −1.13 | −0.86 | 0.026 | 0.051 |
| 12 | −1.09 | −0.79 | −1.18 | −0.85 | 0.029 | 0.012 |
| 13 | −1.09 | −0.73 | −1.16 | −0.80 | 0.023 | 0.015 |
| 14 | −1.07 | −0.92 | −1.19 | −1.23 | 0.028 | 0.126 |
| 16 | −1.12 | −0.99 | −1.20 | −1.05 | 0.021 | 0.013 |
| 17 | −1.11 | −0.86 | −1.23 | −1.16 | 0.025 | 0.041 |

FIGS. 5A, 5B, 6A, 6B, 7A band 7B are graphical representations of the data both interpolated and extrapolated.

Figure 5A:
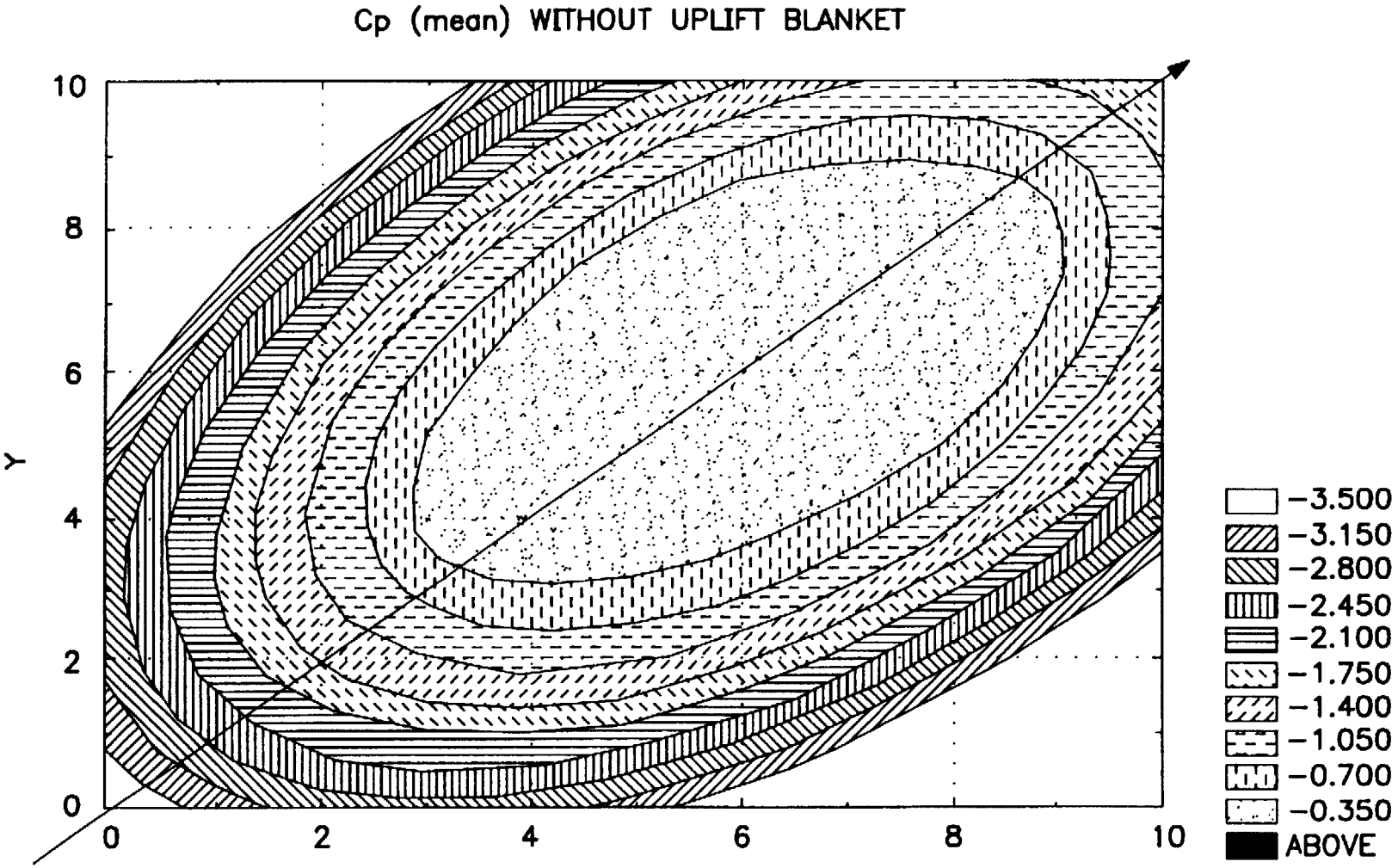
FIG. 5A and 5B are graphical representation of the mean coefficient of pressure across the roof model of FIG. 4 without (FIG. 5A) and with (FIG. 5B) the invention, generated by data smoothing of the readings of the pressure sensors in wind tunnel testing.
Figure 5B:
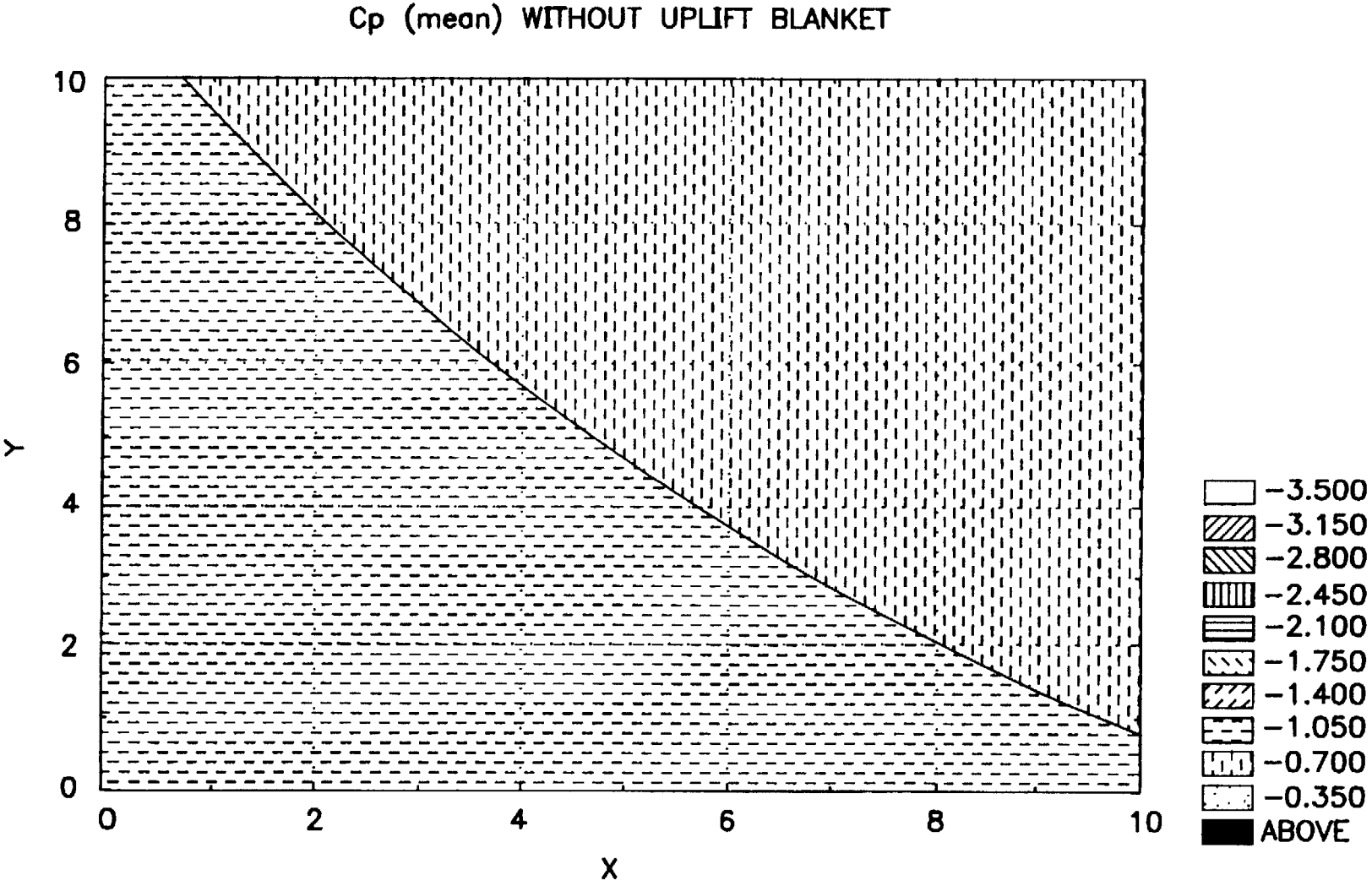

FIG. 5A shows the mean value of the coefficient of pressure of the membrane without the air permeable and resilient mat. FIG. 5B shows the mean value of the coefficent pressure (Cp) of the top of the membrane with the air permeable and resilient mat located on top of the membrane. The data is both interpolated and extrapolated from the data in the above table. The mean value of the coefficent pressure (Cp) is associated with the average load. The coefficient of pressure (Cp) decreased from above −3.50 to generally around −1.10 in zone I. It increased from about −0.70 to generally around −1.05 in zone II. It is applicant's belief that the increase in zone II was the result of the test parameters and would not exist in actually field use.

Figure 6A:
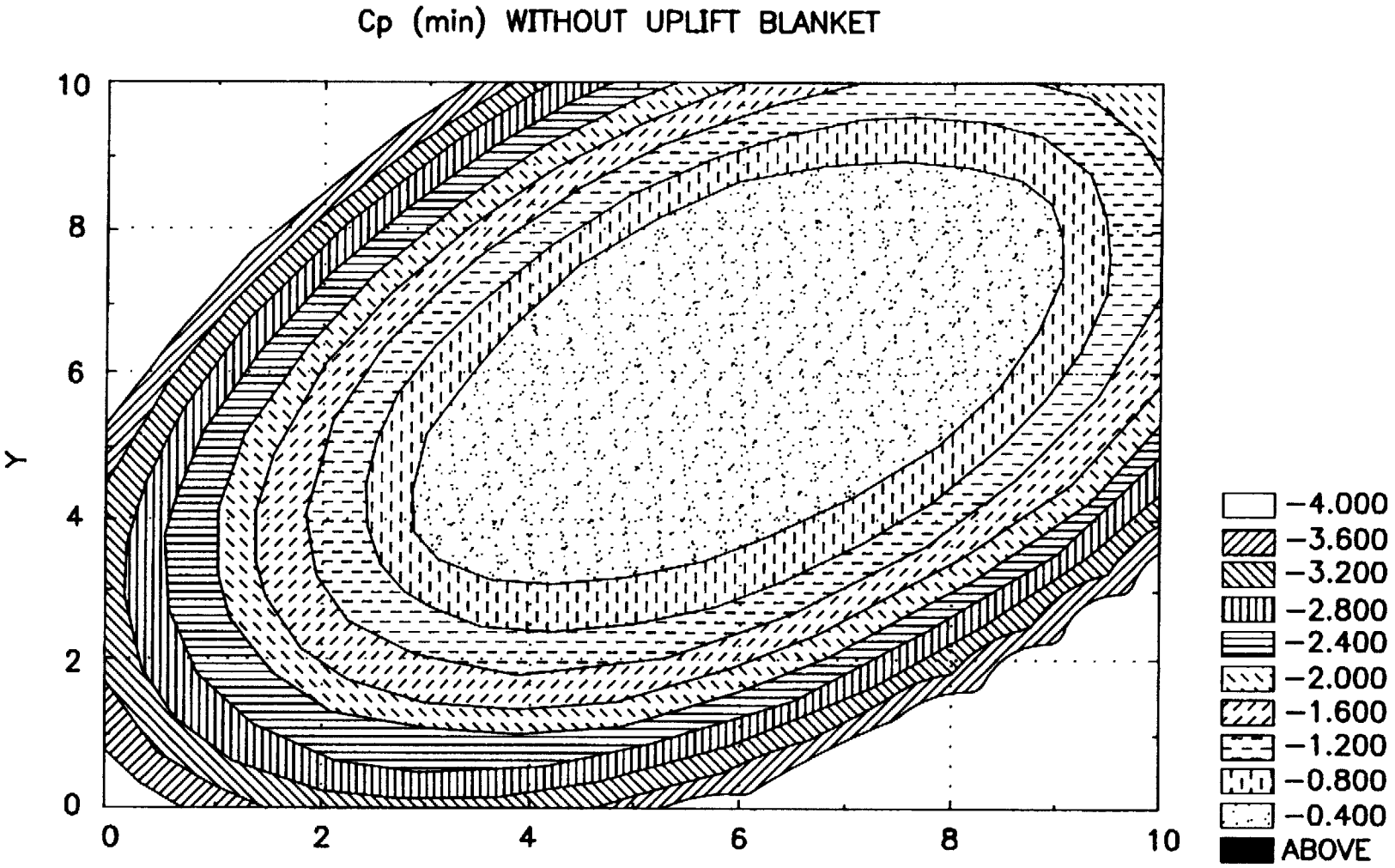
FIGS. 6A and 6B are graphical representation of the minimum coefficient of pressure across the roof model of FIG. 4 without (FIG. 6A) and with (FIG. 6B) the invention, generated by data smoothing of the readings of the pressure sensors in wind tunnel testing.
Figure 6B:
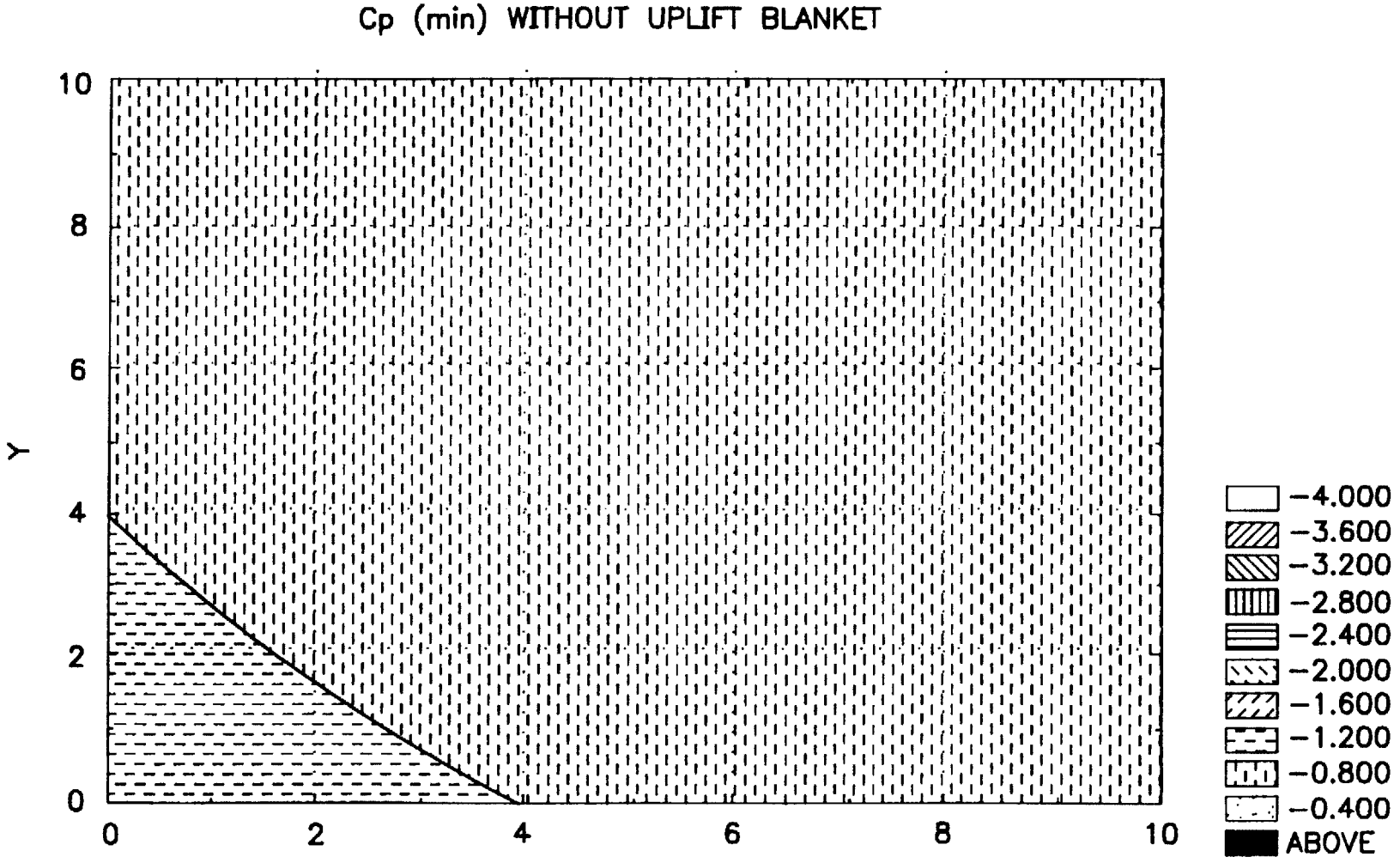

FIG. 6A shows the minimum coefficent of pressure without the air permeable and resilient mat. FIG. 6B shows the minimum coefficent of pressure with the air permeable and resilient mat. The minimum value of the coefficient of pressure is associated with maximum uplift. Wherein without the air permeable and resilient mat, portions of the roof membrane experienced uplift forces associated with a Cp of −4.20 (See tap 21). While the membrane without the mat had a minimum maximum uplift associated with a $C_p$ of −0.70 (see taps 5, 6, 9), with the air permeable and resilient mat overlaying the membrane, the minimum maximum uplift was related to a coefficient of pressure of approximately −1.10. (See taps 5, 6, 7, 11, 15). Therefore, the mat made certain areas have a larger maximum uplift. However, the maximum uplift experienced by any portion of the membrane with the mat was that associated with a coefficient of pressures ($C_p$) of −1.25. Therefore, while the maximum load in certain areas increased, the maximum load for any portion of the roof decreased drastically.

Figure 7A:
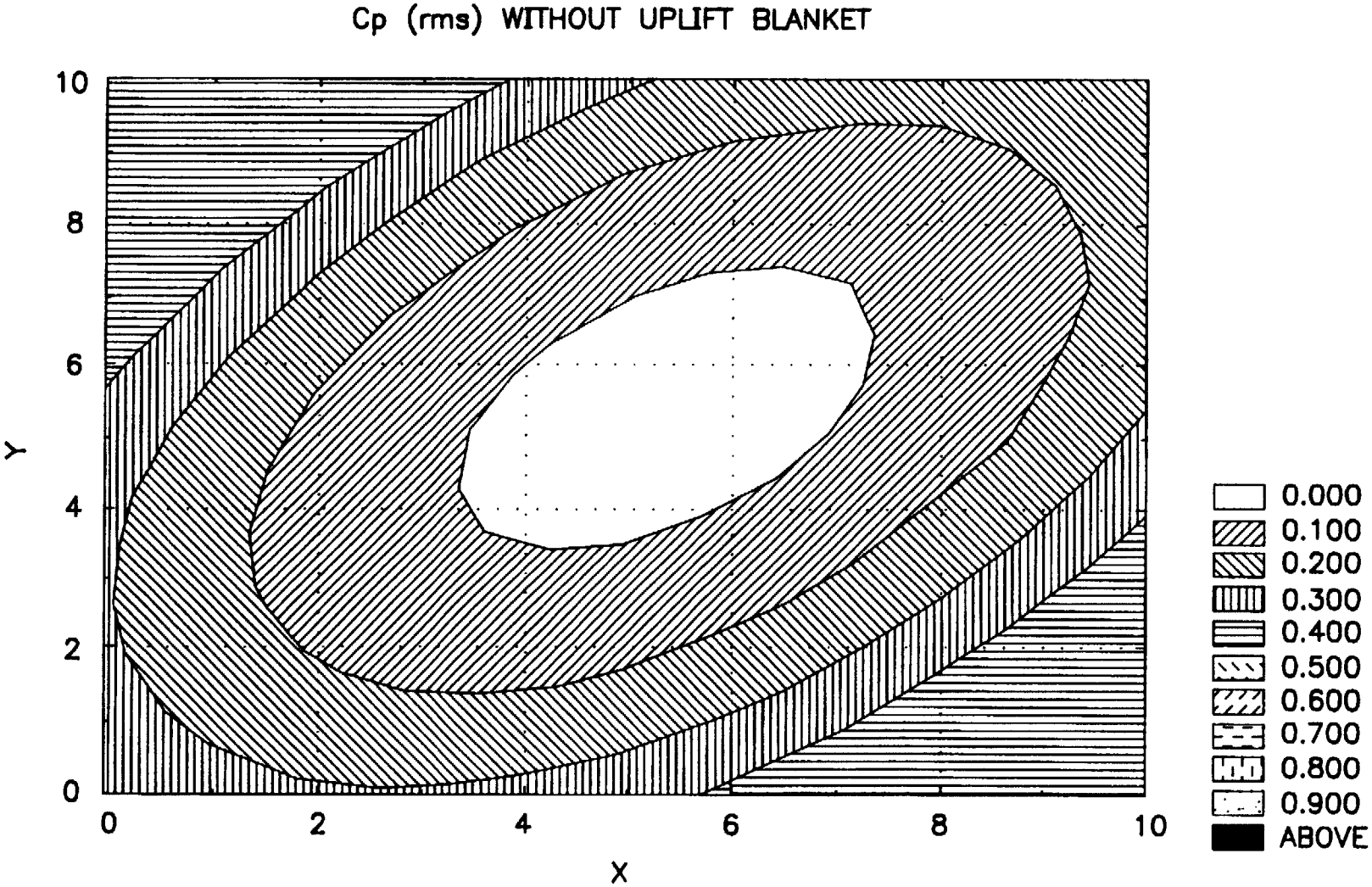
FIG. 7A and 7B are graphical representation of the root mean square values of coefficient of pressure across the roof model of FIG. 4 without (FIG. 7A) and with (FIG. 7B) the invention, generated by data smoothing of the readings of the pressure sensors in wind tunnel testing.
Figure 7B:
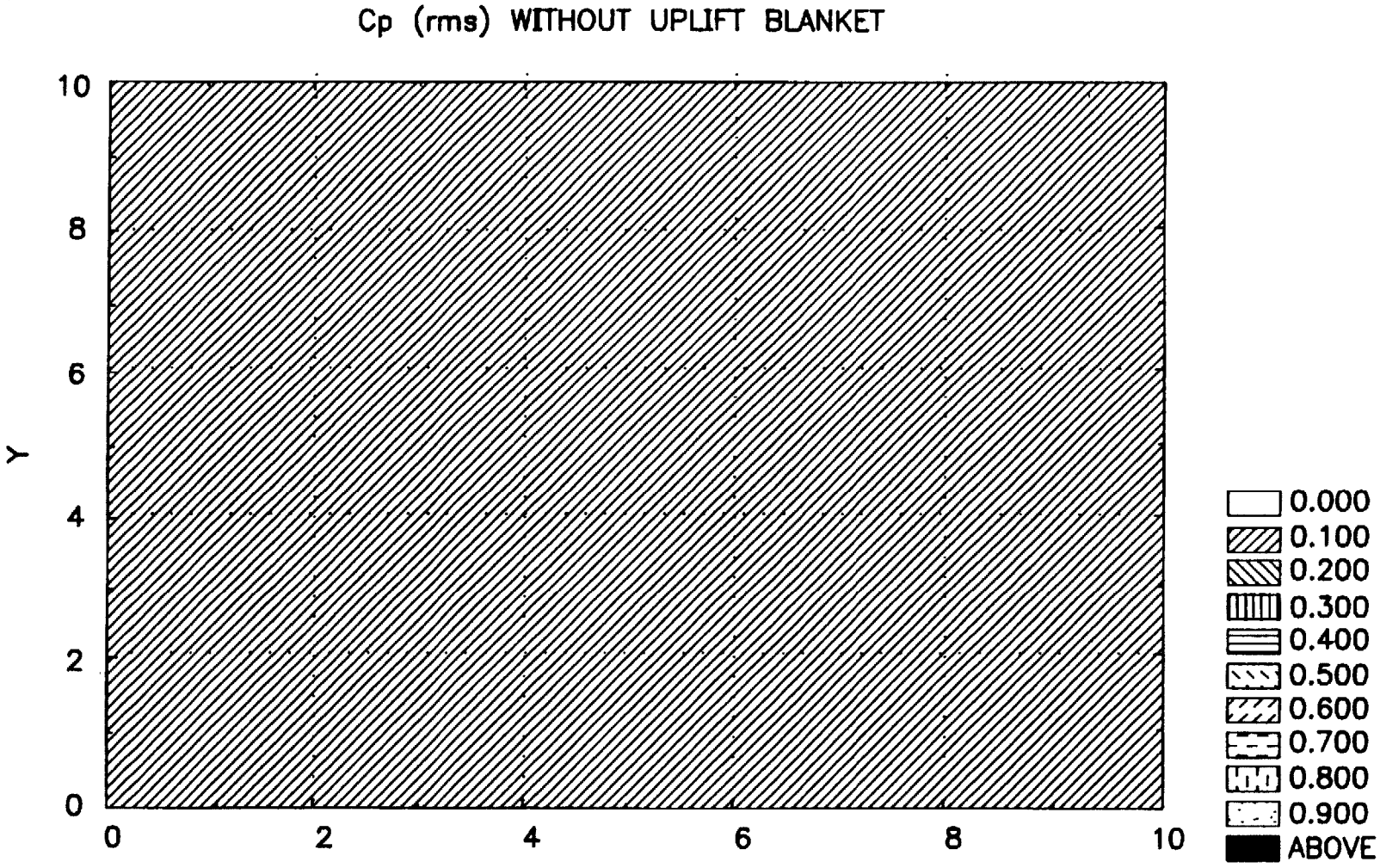

FIGS. 7A and 7B show the root mean square (RMS) of the coefficient of pressure which could be considered to be associated with the energy transferred to the roof membrane by the wind. FIG. 6A shows the RMS of the coefficient of pressure of the membrane without the mat and varies from 0.1 to 0.348. However, the entire membrane which is covered by the mat, has a coefficient of pressure RMS of approximately 0.025.

Therefore, the wind tunnel verifies that the air permeable and resilient mat reduces the maximum uplift experienced by the membrane and in addition creates a more uniform distribution of uplift on the roof. The more uniform uplift on the roof results in less stress to the membrane in that various portions of the membrane are not pulled by contrasting different levels of suction by the wind.

Other benefits of invention

In addition to protecting from wind uplift and preventing the aggregate ballast from scouring, the air permeable mat has additional benefits. As indicated previously, two other design factors that are considered are 1) impact resistance, and 2) the influence of solar radiation and ultraviolet rays. Moreover, the air permeable and resilient mat can reduce the overall load on the roof and is easy to install.

The mat is resilient and relatively rigid. These attributes of the mat result in the mat being able to be walked on and returning to its shape without damage to the underlying membrane. In addition, if a person working on the roof drops a tool such as a wrench, hammer, the impact of the tool will not damage the underlying membrane. Likewise, a sharp object such as a knife or a screw driver will not make contact with the membrane and possible puncture the membrane.

Weather-related damage that have been a concern for flat roofs include items such as wind blow debris including sheet metal, such as from ventilators and air conditioner units, and tree branches blowing across the roof and puncturing the membrane. Another weather-related concern for a membrane roof is hail hitting the membrane puncturing the membrane weakening the adhesive bonds between the membrane and the substrate. In addition in the case of certain rigid insulation, the hail damages the insulation underlying the membrane by permanently compressing the insulating cells. The mat protects the membrane from both kinds of weather related damage discussed, along with other weather-related damage.

The membrane when exposed to ultra-violet rays of the sun deteriorates molecularly. One of the primary purposes of the gravel on the built-up roof is to prevent the ultra-violet rays from hitting the felt and bitumens of the built-up roof. The mat achieves a similar benefit, however not to the same extent.

The mat also can be colored to provide radiation benefits by reducing heat load. In addition, if the roof is visible, the mat can be colored for aesthetic purposes.

The mat does add weight (load) to the roof that must be accounted for in the design of the roof. However, as indicated previously, in a single-ply ballasted roof, the size of aggregate can be reduced. Therefore, the total load added to the roof with the mat is less than that with conventional ballasted single-ply roof.

In that the wind generate forces are compensated by the static coefficent of friction, therefore the air permeable and resilient mat will not blow on the roof while the adhesive is setting. Therefore, an installer will have an easy time installing the mat.

Figure 8:
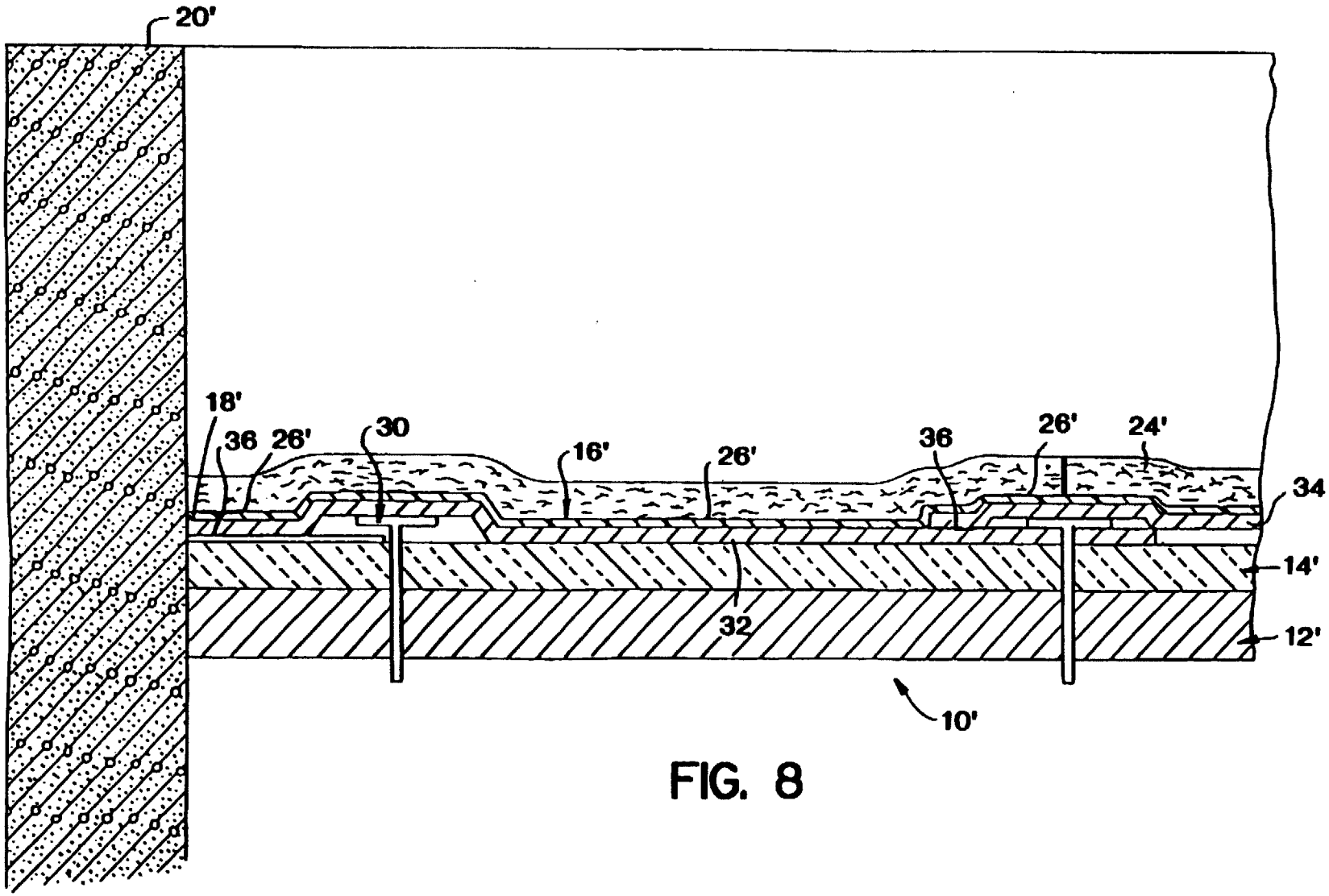
FIG. 8 is a cross-sectional view of a roof of an alternative embodiment of a mechanical affixed single-ply roof.

Other preferred embodiments An alternative embodiment of a single-ply roof mechanically affixed is shown in FIG. 8. The roof structure 10' has a roof deck 12', an insulation layer 14' overlying the roof deck 12'. The roof structure 10' has a single-ply membrane 16' overlying the insulation 14'. The membrane 16' is secured at the periphery 18' in proximity to a parapet 20'. In addition, the membrane 16' is secured to the decking 12' by a plurality of fasteners 30 at designated points to secure the insulation 14' and membrane 16' to the decking 12'. The fastener 30 is secured to the underside of the membrane 16'. Typically the fastener 30 is located at a joint location 30 where the single-ply membrane 16' is formed by joining two sheets together. The sheets are bonded together by heat welding, solvent welding or adhesives to form a larger sheet if required to cover the entire roof. The fastener 30 penetrates through an underlying sheet 32 and adheres to an overlying sheet 34. The sheets 32 and 34 are welded or adhered together at joint 36 such that the fastener 30 is underlying the continuous single-ply membrane 16'. The above construction is conventional and well known.

The roof 10' of the preferred embodiment has an air permeable and resilient member 24' overlying the membrane 16'. The air permeable and resilient member 24', similar to the first embodiment, is a non-woven air permeable and resilient mat made of synthetic fibers (usually nylon, PVC, or polyester) which are open and blended, then randomly aligned into a web by air flow. The web is treated with binding agents of water based phenolics and latexes. The treated web is then oven cured to bind the fabric into relative rigid mats having sufficient porous areas between the random fibers. In the preferred embodiment, the mat 24' has a thickness of ⅜ of an inch. The mat 24' comes in rolls 78 inches wide and 20 yards long. The mat 24' weighs 11.11–13.89 pounds per square and has a fiber percentage of between 35 and 45 percent.

The air permeable and resilient mat 24' is secured to the roof 10' by placing an adhesive or neoprene cement or other comparable adhesive 26' in a 3 inch strip around the periphery of the mat and a 3 inch strip down the center line of the length of the mat 24'. The mat 24 is secured to the membrane 16' to prevent the mat 24' from being pushed across the roof 10.

Figure 9:
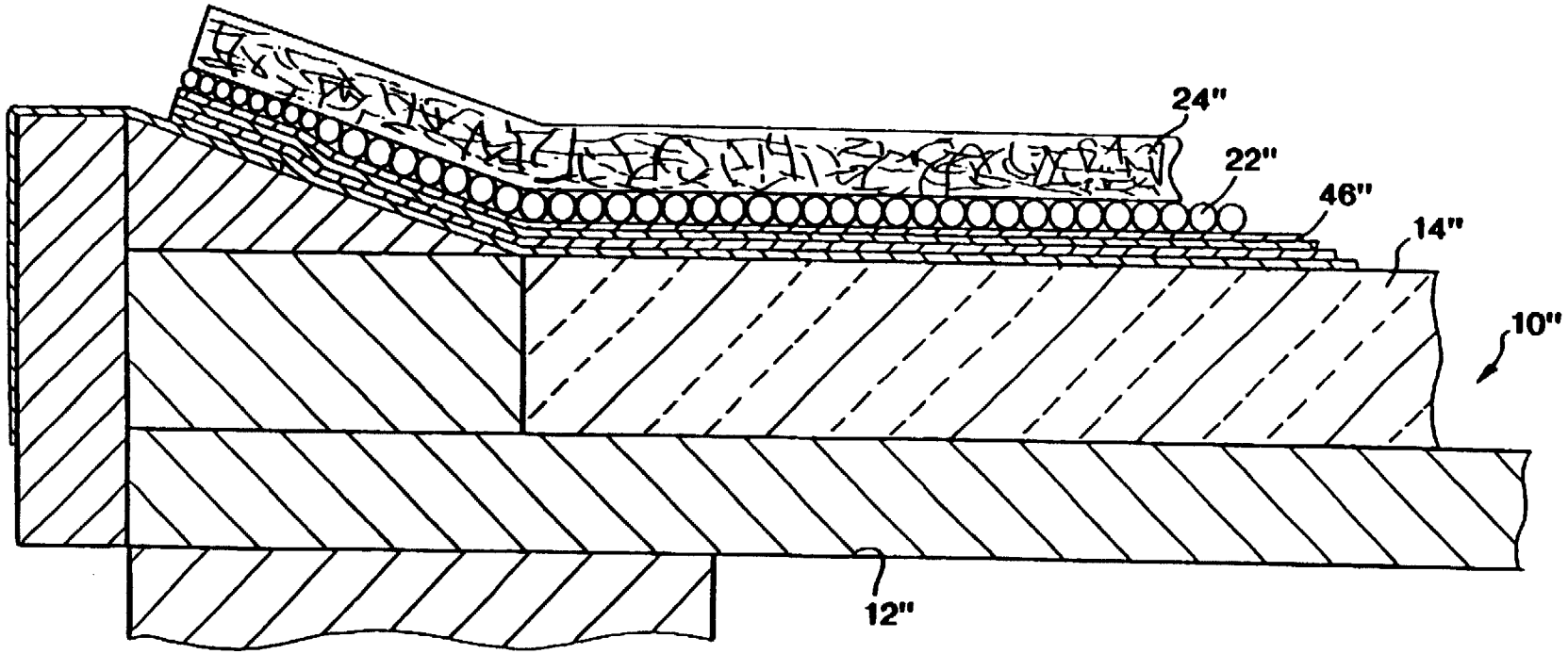
FIG. 9 is a cross-sectional view of a roof of an alternative embodiment of a built-up roof system.

Another preferred embodiment having a built-up roof 10" without a parapet is shown in FIG. 9. The roof structure 10" has a roof decking 12". The roof structure 10" has an insulation layer 14" or plurality of insulation layers. The insulation layer 14" overlies the roofing deck 12" and is laid on the decking 12" and is secured by mechanical fasteners. The roof structure 10" has a built-up membrane 46" comprising layers of roofing felt interposed with bituminous (roofing asphalt). The top layer of bitumen may or may not receive a layer of gravel aggregate 22" at a ratio of 200 pounds to 60 pounds square asphalt. The roof structure 10", in addition, may have 200 pounds per square of gravel of ¼ to ⅜ of an inch diameter on top. The above construction is conventional and well known.

The roof 10" has an air permeable and resilient mat 24" overlying the aggregate 22" or roof membrane 46". The air permeable and resilient mat 24" in the preferred embodiment is a non-woven air permeable and resilient mat made of synthetic fibers (usually nylon, PVC or polyester) which are open and blended, then randomly aligned into a web by air flow. The web is treated with binding agents or water based phenolics and latexes. The treated web is then oven cured to bind the fabric into relatively rigid mats having a significant porous area between the random fibers. The mat 24" has a thickness of ¾ of an inch and comes in rolls 78 inches wide and 34 yards long. The mat 24" weighs 31.25 pounds per square and has a percent open area of 71.43.

The air permeable and resilient mat 24" is secured to the roof 10" using a suitable adhesive in the same method described in the first embodiment or being hot mopped into place. An alternative method is to place a plurality of pavers 48 on the roof 10" underlying the mat 24" and secure the mat 24" to the pavers 48.

Figure 10:
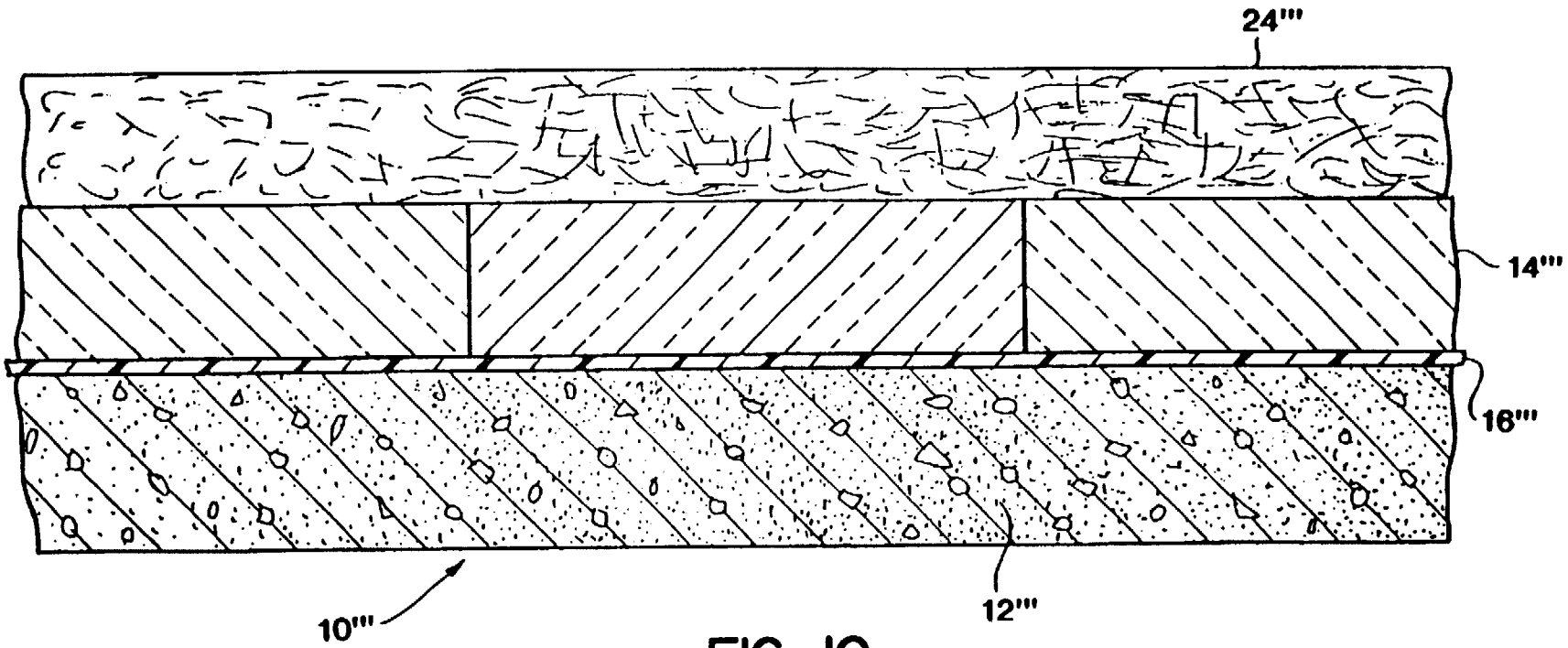
FIG. 10 is a cross-sectional view of a roof of an alternative embodiment of a roof system called an "upside-down" roof.

FIG. 10 shows an alternative embodiment of an "upside-down" roof 10'", a roof where the insulation layer is on top of the membrane 16'". The roof structure 10'" has a roof decking 12'". FIG. 6 shows the roof decking 12'" formed of concrete; the roof decking 12'" can also be formed of wood, corrugated steel, gypsum and other suitable materials. The roof structure 10''' has a single-ply membrane 16''' overlies the roof decking 12'''. The single-ply membrane 16''' is secured at the periphery of the roof deck 12''', not shown. The single-ply membrane 16''' is not secured except at the periphery 18 and simply overlies the roof deck 12'''. The single-ply membrane 16''' is formed in sheets. The sheets are bonded together by heat welding, solvent welding or adhesives, to form a larger sheet if required to cover the entire roof.

Overlying the membrane 16''' is an insulation layer 14''', or plurality of insulation layers. The insulation layer 14''' is secured by an adhesive fastener to the underlying membrane 16'''. The above construction is conventional and well known.

The roof 10''' has an air permeable and resilient mat 24''' overlying the insulation layer 24'''. The air permeable and resilient mat 24''' is similar to those described in the other embodiments. The air permeable and resilient mat 24'' is secured to the roof 10'' using neoprene or another suitable adhesive to the insulation layer 24'''. An alternative method is to place a plurality of pavers on the roof 10'' underlying the mat 24'' and secure the mat 24'' to the pavers.

The present invention may be embodied in other specific forms without departing from the spirit or central attributes thereof and, accordingly, reference should be made to the dependent claims, rather than to the foregoing specification, as indicating the scope of the invention.

I claim:

1. A method of reducing and redistributing uplift forces on a flat roof resulting from a wind blowing over the roof at a rooftop wind speed creating a pressure differential, comprising the steps of:

providing a flat roof having a membrane; and installing an air permeable and resilient mat, constructed of randomly aligned fibers which are joined by a binding agent, over the membrane, the mat having openings of a size to reduce the wind velocity over the membrane from that of rooftop wind speed while the openings being of a size that the mat is not lifted by the pressure differential therein reducing and redistributing uplift forces on the membrane.

2. A method of reducing and redistributing uplift forces on a flat roof as in claim 1 wherein said mat has a porous surface which creates turbulence over the roof therein disrupting the uplift forces.

3. A method of reducing and redistributing uplift forces on a flat roof as in claim 1 wherein said air permeable and resilient mat is constructed of randomly aligned synthetic fibers which are open and blended, randomly aligned into a web by an airflow, joined by phenolic and latex binding agents and heat cured to produce a varying mesh.

4. A method of reducing total uplift forces and of redistributing uplift forces on a flat roof's waterproof membrane resulting from a wind blowing over the flat roof at a rooftop wind speed, comprising the steps of:

installing an air permeable mat constructed of convoluted mesh fibers over substantially the entire surface area of the membrane, the mesh having openings of a size to reduce the wind velocity over the membrane from that of rooftop wind speed and to redistribute uplift forces across the membrane.

5. A method as in claim 4, wherein the convoluted mesh is formed by randomly aligned fibers which are joined by a binding agent.

* * * * *